US011631954B2

(12) United States Patent
Nakagawa

(10) Patent No.: US 11,631,954 B2
(45) Date of Patent: Apr. 18, 2023

(54) COAXIAL CONNECTOR FOR A CIRCUIT BOARD

(71) Applicant: I-PEX Inc., Kyoto (JP)

(72) Inventor: Yuta Nakagawa, Tokyo (JP)

( * ) Notice: Subject to any disclaimer, the term of this patent is extended or adjusted under 35 U.S.C. 154(b) by 239 days.

(21) Appl. No.: 17/237,058

(22) Filed: Apr. 22, 2021

(65) Prior Publication Data

US 2021/0265790 A1 Aug. 26, 2021

Related U.S. Application Data

(63) Continuation of application No. PCT/JP2019/041569, filed on Oct. 23, 2019.

(30) Foreign Application Priority Data

Oct. 26, 2018 (JP) ..... JP2018-201507

(51) Int. Cl.

| | |
|---|---|
| ***H01R 12/00*** | (2006.01) |
| ***H01R 24/50*** | (2011.01) |
| ***H01R 9/05*** | (2006.01) |
| ***H01R 13/40*** | (2006.01) |
| ***H01R 13/6471*** | (2011.01) |

(52) U.S. Cl.

CPC ..... *H01R 24/50* (2013.01); *H01R 9/05* (2013.01); *H01R 13/40* (2013.01); *H01R 13/6471* (2013.01)

(58) Field of Classification Search

CPC ..... H01R 24/38; H01R 24/40; H01R 24/50; H01R 9/05; H01R 13/40; H01R 13/6461; H01R 13/6471

USPC ..... 439/63

See application file for complete search history.

(56) References Cited

U.S. PATENT DOCUMENTS

| | | | |
|---|---|---|---|
| 5,102,353 | A | 4/1992 | Brunker et al. |
| 2010/0304589 | A1 | 12/2010 | Tuin et al. |
| 2012/0108103 | A1 | 5/2012 | Ootani et al. |

(Continued)

FOREIGN PATENT DOCUMENTS

| | | |
|---|---|---|
| CN | 101901976 | 12/2010 |
| CN | 102468550 | 5/2012 |

(Continued)

OTHER PUBLICATIONS

International Search Report dated Mar. 12, 2019 for PCT/JP2019/041569.

(Continued)

*Primary Examiner* — Khiem M Nguyen

(74) *Attorney, Agent, or Firm* — Soei Patent & Law Firm

(57) ABSTRACT

A coaxial connector device includes an insulating body disposed on a circuit board, first and second signal contact members and, a ground contact member, and a conductive partition member. Each of the first and second signal contact members is assembled to the insulating body and has a contact portion protruding from the insulating body and a signal joint portion configured to be joined to a signal terminal portion disposed on the circuit board. The ground contact member is assembled to the insulating body and has a surrounding contact portion surrounding the contact portion and a ground joint portion configured to be joined to a ground terminal disposed on the circuit board. The conductive partition member is disposed between the contact portions and is configured to be provided with a ground potential.

20 Claims, 15 Drawing Sheets

(56) References Cited

U.S. PATENT DOCUMENTS

| | | | |
|---|---|---|---|
| 2015/0311619 | A1 | 10/2015 | Kato |
| 2015/0357729 | A1 | 12/2015 | Uratani et al. |
| 2019/0280409 | A1 | 9/2019 | Hoshiba et al. |
| 2021/0242631 | A1 | 8/2021 | Nakagawa |
| 2021/0265790 | A1 | 8/2021 | Nakagawa |

FOREIGN PATENT DOCUMENTS

| | | |
|---|---|---|
| JP | H6-052936 | 2/1994 |
| JP | H8-241762 | 9/1996 |
| JP | 2003-297502 | 10/2003 |
| JP | 2010-278007 | 12/2010 |
| JP | 2012-099299 | 5/2012 |
| JP | 2016-012553 | 1/2016 |
| JP | 2016-100190 | 5/2016 |
| JP | 2018-116925 | 7/2018 |
| WO | 2014/084293 | 6/2014 |

OTHER PUBLICATIONS

International Search Report dated Mar. 12, 2019 for PCT/JP2019/041572.

International Preliminary Report on Patentability with Written Opinion dated May 6, 2021 for PCT/JP2019/041569.

International Preliminary Report on Patentability with Written Opinion dated May 6, 2021 for PCT/JP2019/041572.

SOEI Patent and Law Firm, Statement of Related Matters, dated Jun. 8, 2021.

COAXIAL CONNECTOR FOR A CIRCUIT BOARD

CROSS-REFERENCE TO RELATED APPLICATIONS

This application is a continuation application of PCT Application No. PCT/JP2019/041569, filed on Oct. 23, 2019, which claims the benefit of priority from Japanese Patent Application No. 2018-201507, filed on Oct. 26, 2018, the entire contents of which are incorporated herein by reference.

BACKGROUND

1. Field

The present disclosure relates to a coaxial connector device mounted on a circuit board. A mate coaxial connector device to which a plurality of coaxial cables are connected is fitted and connected to the coaxial connector device. The plurality of coaxial cables are electrically connected to the circuit board by fitting and connecting a mate coaxial connector device to the coaxial connector device.

2. Description of the Related Art

For transmission of a radio frequency signal between a plurality of electric components, electric devices, electronic apparatuses, or the like, a coaxial cable is used in many cases, in which a central conductor and an outer conductor surrounding the central conductor via an inner insulating member are covered with an outer insulating sheath to form a signal transmission route that is not easily affected by external noise. For example, a coaxial cable is connected to a circuit board handling a radio frequency signal, and the radio frequency signal is transmitted from the circuit board to the outside through the coaxial cable, or the radio frequency signal is transmitted from the outside to the circuit board through the coaxial cable.

When the coaxial cable is connected to the circuit board, for example, a cable side coaxial connector device is attached to one end of the coaxial cable, and the cable side coaxial connector device is fitted and connected to a board side coaxial connector device attached to the circuit board. The cable side coaxial connector device includes a signal contact to which the central conductor of the coaxial cable is joined and a ground contact to which the outer conductor of the coaxial cable is joined. The board side coaxial connector device includes a signal connection contact through which a radio frequency signal handled in the circuit board is provided, and an annular ground connection contact which is disposed to surround the signal connection contact and is provided with a ground potential. In the fitting and connecting of the cable side coaxial connector device to the board side coaxial connector device, for example, the ground contact of the cable side coaxial connector device is fitted and connected to the annular ground connection contact of the board side coaxial connector device, and the signal contact of the cable side coaxial connector device is connected to the signal connection contact of the board side coaxial connector device.

When the cable side coaxial connector device is fitted and connected to the board side coaxial connector device, the board side coaxial connector device attached to the parts mount surface of the circuit board is configured to direct, for example, the signal connection contact and the annular ground connection contact above the parts mount surface of the circuit board. For the board side coaxial connector device, the cable side coaxial connector device mounted at one end of the coaxial cable is engaged with the board side coaxial connector device along a direction from above the parts mount surface to the parts mount surface in the circuit board, so that the ground contact of the cable side coaxial connector device is fitted and connected to the annular ground connection contact of the board side coaxial connector device, and the signal contact of the cable side coaxial connector device is connected to the signal connection contact of the board side coaxial connector device. Therefore, the board side coaxial connector device occupies a predetermined area in the parts mount surface in the circuit board, and the cable side coaxial connector device fitted and connected to the board side coaxial connector device protrudes from the parts mount surface in the circuit board.

As described above, when a coaxial cable is connected to a circuit board using a cable side coaxial connector device and a board side coaxial connector device, it is often necessary to connect a plurality of coaxial cables to the circuit board. In such a case, it is desired that each of the plurality of coaxial cables is reliably connected to the circuit board while limiting as much as possible the area occupied by the connector device required for connecting the plurality of coaxial cables to the circuit board in the parts mount surface of the circuit board.

Therefore, in the related art, a board side coaxial connector device disposed on a parts mount surface of a circuit board has been proposed in which two signal connection contacts are assembled to a common insulating body and contact portions of the two signal connection contacts are surrounded by a common ground connection contact assembled to the common insulating body, thereby reducing an area in the parts mount surface of the circuit board occupied by the board side coaxial connector device used to electrically connect the two coaxial cables to the circuit board (for example, see Japanese Unexamined Patent Application Publication No. 2012-99299).).

A board side coaxial connector device (receptacle member (41)) disclosed in Japanese Unexamined Patent Application Publication No. 2012-99299 is configured to be mounted on a parts mount surface of a circuit board. In such a board side coaxial connector device, a first signal connection contact (receptacle central contact (46)) and a second signal connection contact (receptacle central contact (47)) are attached to a common insulating body (receptacle insulator (45)). A first contact portion (receptacle central contact's contact portion (50)) in the first signal connection contact and a second contact portion (receptacle central contact's contact portion (53)) in the second signal connection contact are surrounded by a common ground connection contact (receptacle outer contact (44)). A signal contact of a mate coaxial connector device is in contact with the first contact portion. Another signal contact of the mate coaxial connector device is in contact with the second contact portion. The common insulating body, the first signal connection contact and the common ground connection contact substantially constitute a first receptacle connector (first receptacle (42)), and the common insulating body, the second signal connection contact and the common ground connection contact substantially constitute a second receptacle connector (second receptacle (43)).

In the board side coaxial connector device disclosed in Japanese Unexamined Patent Application Publication No. 2012-99299, the first receptacle connector and the second receptacle are provided for electrical connection of the two coaxial cables to the circuit board. Each of the first receptacle connector and the second receptacle connector is configured by using a common insulating body and a common ground connection contact, so that the first contact portion of the first signal connection contact and the second contact portion of the second signal connection contact are disposed close to each other with a small gap therebetween. This is expected to reduce the area occupied by the board side coaxial connector device on the circuit board.

SUMMARY

In the above-described board side coaxial connector device proposed in the related art, first and second signal connection contacts are assembled to a common insulating body, and first and second contact portions included therein are configured to be surrounded by a common ground connection contact assembled to the common insulating body and disposed on a parts mount surface of a circuit board. In this board side coaxial connector device, the first contact portion of the first signal connection contact and the second contact portion of the second signal connection contact are arranged close to each other with a small gap therebetween. Accordingly, transmission characteristics of a radio frequency signal transmitted through the first contact portion of the first signal connection contact and a radio frequency signal transmitted through the second contact portion of the second signal connection contact may be deteriorated. That is, for example, a radio frequency signal transmitted through the first contact portion of the first signal connection contact is mixed as crosstalk noise into a radio frequency signal transmitted through the second contact portion of the second signal connection contact, and a radio frequency signal transmitted through the second signal connection contact is mixed as crosstalk noise into a radio frequency signal transmitted through the first contact portion of the first signal connection contact.

In view of the foregoing, it is an object of the present disclosure to provide a board side coaxial connector device to be mounted on a parts mount surface of a circuit board, which is capable of reducing an area occupied by the board side coaxial connector device to which a cable side coaxial connector device having a plurality of coaxial cables connected thereto is fitted and connected, in the parts mount surface of the circuit board, and preventing transmission characteristics of a radio frequency signal transmitted through the board side coaxial connector device from deteriorating.

Disclosed herein is an example coaxial connector device. The coaxial connector device may include: an insulating body disposed on a surface of a circuit board; and first and second signal contact members. Each of the first and second signal contact members may be assembled to the insulating body and include: a contact portion configured so that a signal contact member of a mate connector device comes into contact with the contact portion; and a signal joint portion configured to be joined to a signal terminal portion disposed on the circuit board. The coaxial connector device may further include a ground contact member assembled to the insulating body. The ground contact member may include: a surrounding contact portion surrounding the contact portion of each of the first and second signal contact members and configured so that a ground contact member of the mate connector device comes into contact with the surrounding contact portion; and a ground joint portion configured to be joined to a ground terminal disposed on the circuit board. The coaxial connector device may further include a conductive partition member disposed between the contact portion of the first signal contact member and the contact portion of the second signal contact member and configured to be provided with a ground potential.

Additionally, another example connector is disclosed herein. The connector is a connector for connecting a circuit board to a mate connector having a mate first signal contact, a mate second signal contact, and a mate conductive surrounding portion surrounding at least a portion of the mate first signal contact and at least a portion of the mate second signal contact. The connector may include a first signal contact configured to be joined to a first signal terminal of the circuit board and to be in contact with the mate first signal contact to transmit a first signal; and a second signal contact configured to be joined to a second signal terminal of the circuit board and to be in contact with the mate second signal contact to transmit a second signal. The connector may further include a conductive surrounding portion surrounding at least a portion of the first signal contact and at least a portion of the second signal contact. The conductive surrounding portion may be configured to be joined to a ground terminal of the circuit board and to fit into the mate conductive surrounding portion. The connector may further include a conductive partition partitioning an inner area of the conductive surrounding portion into a first region in which at least a portion of the first signal contact is disposed and a second region in which at least a portion of the second signal contact is disposed. The conductive partition may be configured to be joined to a ground terminal of the circuit board. The connector may be configured to transmit only one signal in the first region at any point in time, including the first signal. The connector may be configured to transmit only one signal in the second region at any point in time, including the second signal.

According to the coaxial connector device of the present disclosure, the contact portion of the first signal contact member and the contact portion of the second signal contact member, which are commonly surrounded by the surrounding contact portion of the ground contact member, are disposed close to each other at a small gap on the insulating body disposed on the surface of the circuit board. Accordingly, since the area of the insulating body is reduced, the area occupied by the coaxial connector device on the surface of the circuit board on which the insulating body is disposed can be reduced. Since the conductive partition member with which the ground potential is provided is disposed in the small gap between the contact portion of the first signal contact member and the contact portion of the second signal contact member, the contact portion of the first signal contact member and the contact portion of the second signal contact member are electromagnetically shielded from each other by the conductive partition member with which the ground potential is provided. As a result, the radio frequency signal transmitted through the contact portion of the first signal contact member is prevented from mixing as crosstalk noise into the radio frequency signal transmitted through the contact portion of the second signal contact member, and the radio frequency signal transmitted through the contact portion of the second signal contact member is prevented from mixing as crosstalk noise into the radio frequency signal transmitted through the contact portion of the first signal contact member. As a result, it is possible to avoid a situation in which transmission characteristics of radio frequency signals transmitted through the contact portion of the first signal contact member and the contact portion of the second signal contact member are degraded.

In addition, in the coaxial connector device according to the present disclosure, when the board joint portion extending through the insulating body to be joined and connected to the ground terminal disposed on the circuit board is provided on the conductive partition member, the ground potential can be easily provided from the circuit board to the conductive partition member, and the conductive partition member interposing the insulating body can be firmly installed on the circuit board.

Further, in the coaxial connector device according to the present disclosure, when the conductive partition member is integrally formed with the ground contact member so as to be bent and extended from a portion of the surrounding contact portion of the ground contact member, the number of components can be reduced, the structure can be simplified, and the conductive partition member can be firmly disposed in the insulating body.

DETAILED DESCRIPTION

Figure 1:
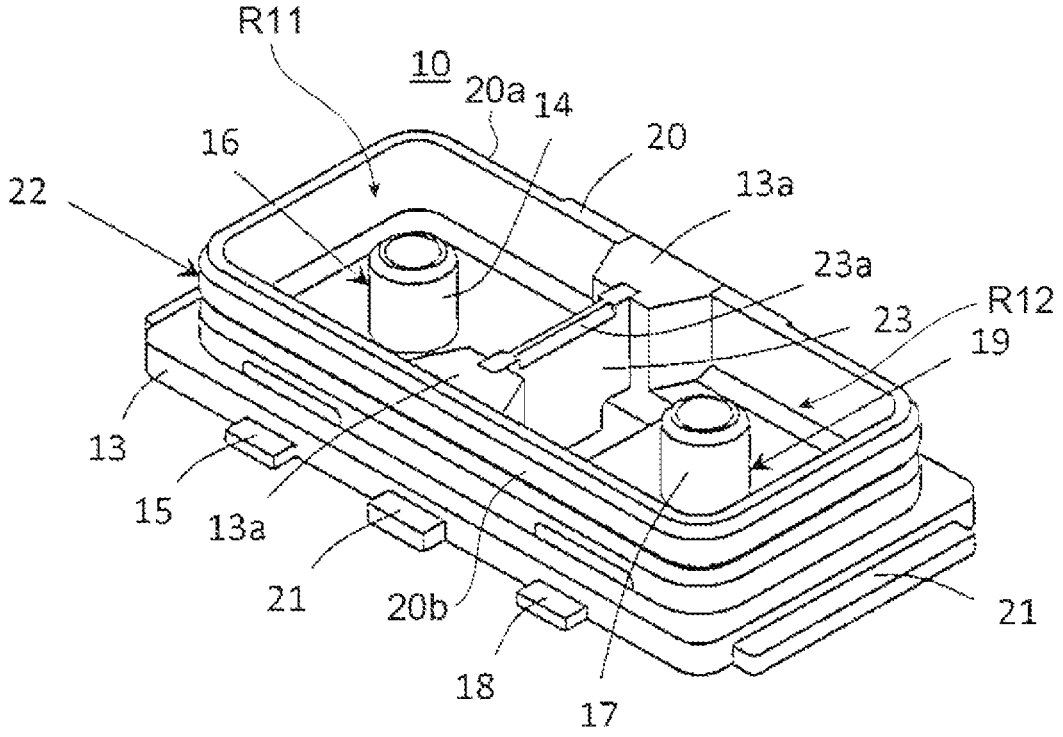
FIG. 1 is a perspective view of an example of a coaxial connector device as viewed from above.

Hereinafter, with reference to the drawings, the same elements or similar elements having the same function are denoted by the same reference numerals, and redundant description will be omitted.

Figure 2:
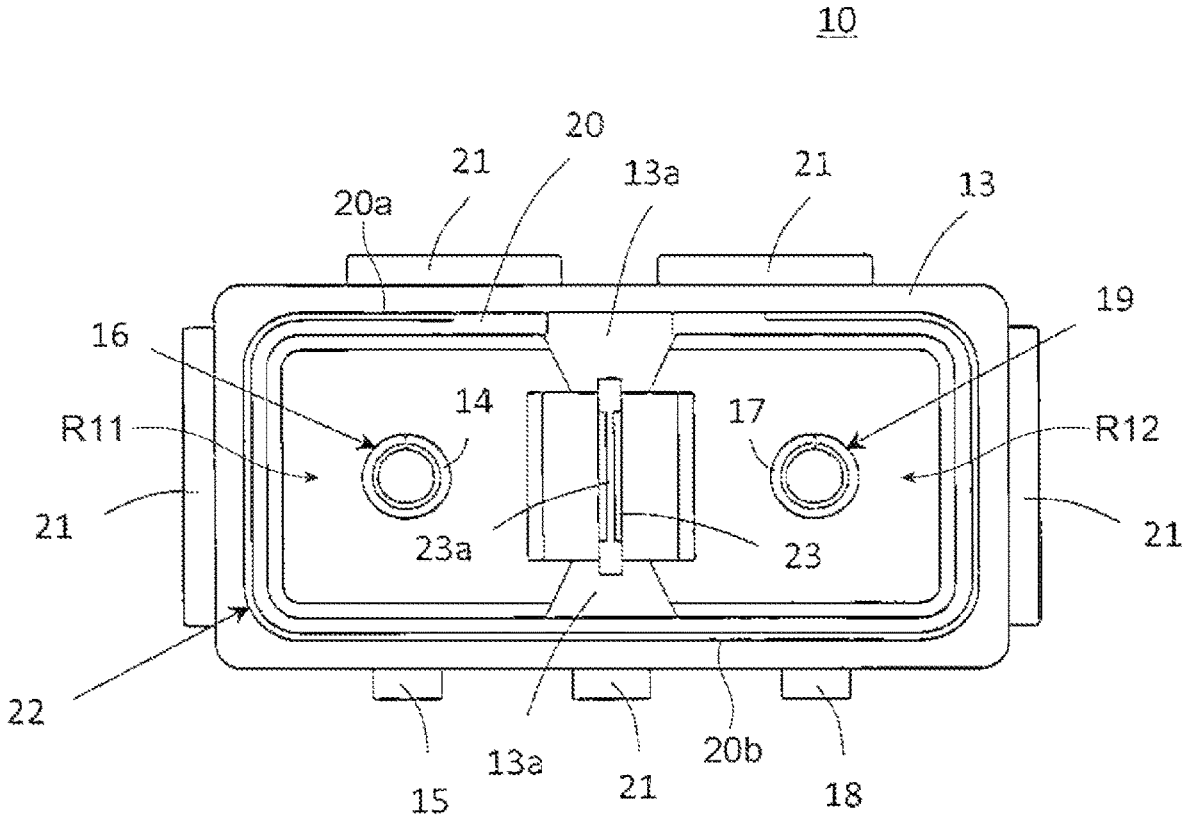
FIG. 2 is a plan view showing an example of the coaxial connector device.
Figure 3:
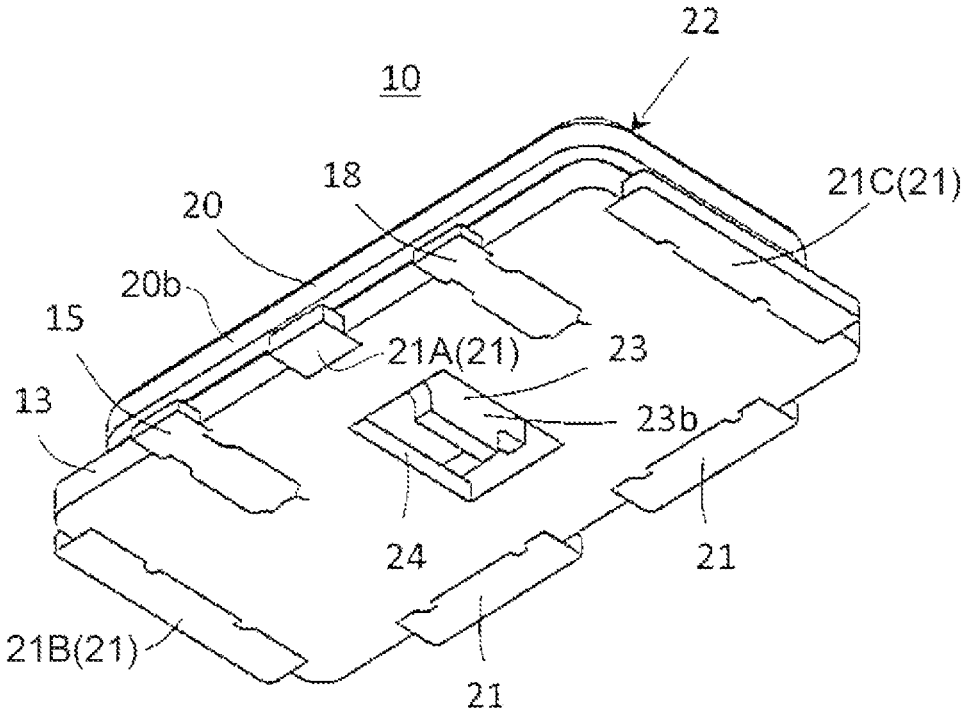
FIG. 3 is a perspective view of an example of the coaxial connector device as viewed from below.

FIGS. 1, 2 and 3 show an example of a coaxial connector device according to the present disclosure.

Figure 9:
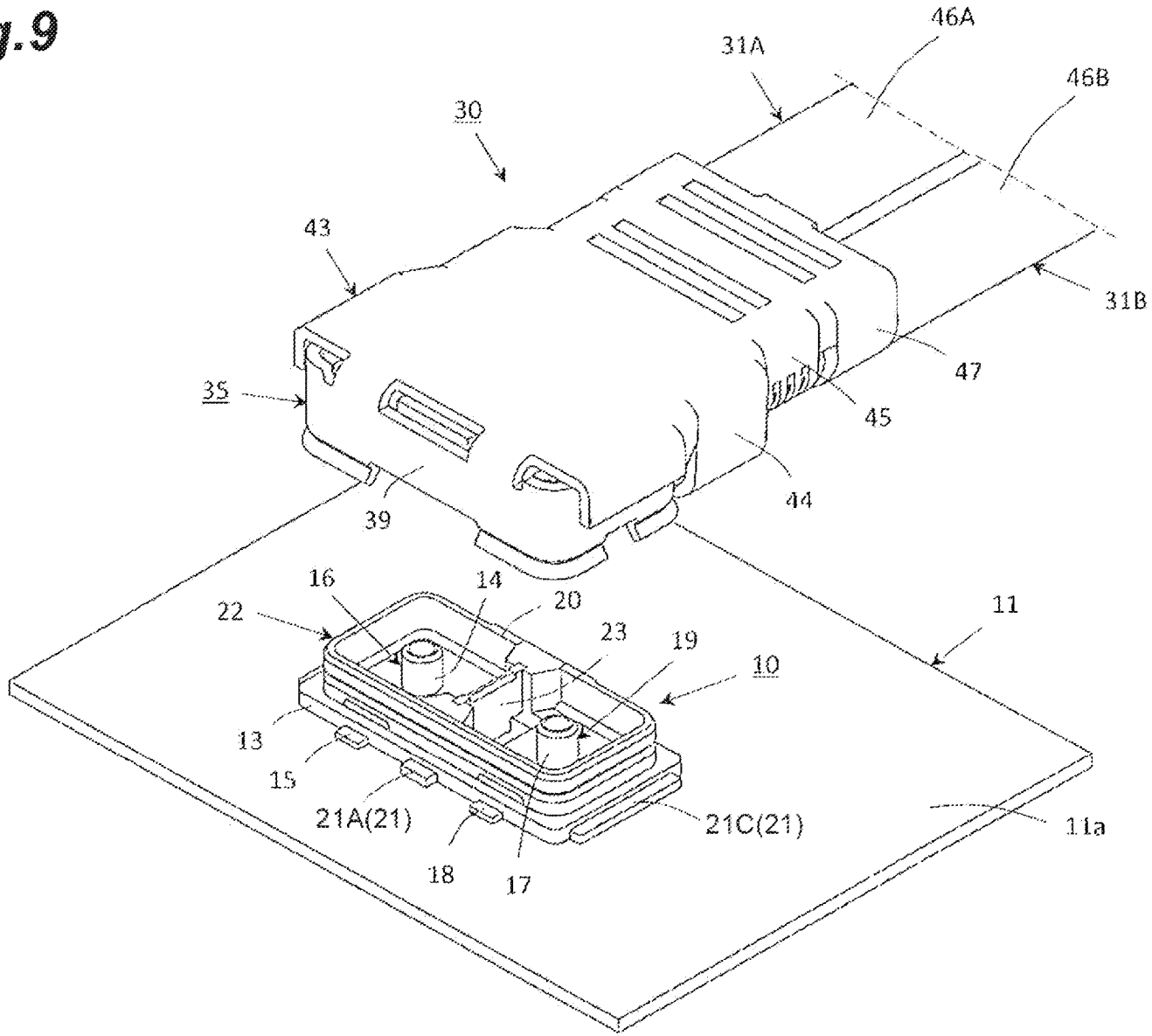
FIG. 9 is a perspective view showing a state in which the mate coaxial connector device to which the plurality of coaxial cables are connected is disposed opposite to an example of the coaxial connector device attached to a circuit board.
Figure 10:
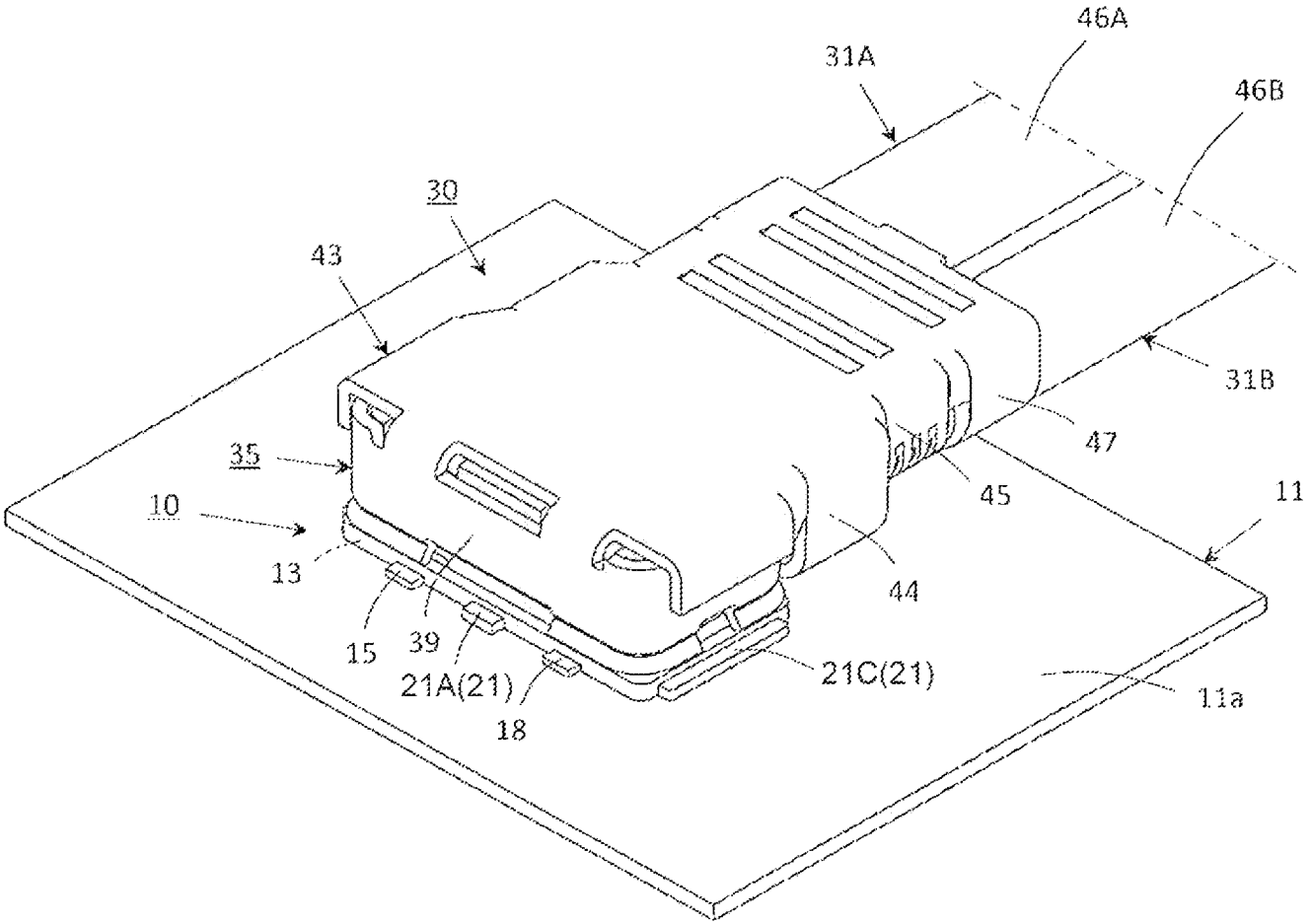
FIG. 10 is a perspective view showing a state in which the mate coaxial connector device to which the plurality of coaxial cables are connected is fitted and connected to an example of the coaxial connector device mounted on the circuit board.

The coaxial connector device 10 shown in FIGS. 1, 2, and 3 is an example of a coaxial connector device, and is a board side coaxial connector device to which a cable side coaxial connector device, which is a mate coaxial connector device to which a plurality of coaxial cables are connected, is fitted and connected. The coaxial connector device 10 is fixed to the parts mount surface 11*a* of the circuit board 11 and is used in practice. Although the circuit board 11 is not shown in FIGS. 1, 2, and 3, the circuit board 11 is shown in FIGS. 9 and 10 described later. The coaxial connector device is a connector for connecting the circuit board 11 to a mate connector having a mate first signal contact, a mate second signal contact, and a mate conductive surrounding portion surrounding at least a portion of the mate first signal contact and at least a portion of the mate second signal contact.

The coaxial connector device 10 includes an insulating body 13, a first signal contact member 16 (a first signal contact), and a second signal contact member 19 (a second signal contact). The insulating body 13 is formed of an insulating material such as a synthetic resin into a flat plate shape, and is disposed on the parts mount surface 11*a* of the circuit board 11. The first signal contact member 16 is formed of a metal material and assembled to the insulating body 13. The first signal contact member 16 has a contact portion 14 (a first contact portion) and a signal joint portion 15 (a first joint portion). The contact portion 14 protrudes from the insulating body 13. A signal contact member connected to a central conductor of a coaxial cable in a mate coaxial connector device comes into contact with the contact portion 14. The signal joint portion 15 extends from the contact portion 14 to the outside of the insulating body 13. The signal joint portion 15 is joined to a signal terminal disposed on the parts mount surface 11*a* of the circuit board 11. The first signal contact member 16 is joined to a first signal terminal of the circuit board 11 and is in contact with the mate first signal contact to transmit a first signal. The second signal contact member 19 is also formed of a metal material and assembled to the insulating body 13. The second signal contact member 19 has a contact portion 17 (a second contact portion) and a signal joint portion 18 (a second contact portion). The contact portion 17 protrudes from the insulating body 13. A signal contact member connected to a central conductor of a coaxial cable in the mate coaxial connector device comes into contact with the contact portion 17. The signal joint portion 18 extends from the contact portion 17 to the outside of the insulating body 13. The signal joint portion 18 is joined to a signal terminal portion disposed on the parts mount surface 11*a* of the circuit board 11. The second signal contact member 19 is joined to a second signal terminal of the circuit board 11 and is in contact with the mate second signal contact to transmit a second signal. The contact portion 14 of the first signal contact member 16 and the contact portion 17 of the second signal contact member 19 are disposed on the insulating body 13 to face each other with a relatively small gap therebetween.

The coaxial connector device 10 also includes a surrounding contact portion 20 (a conductive surrounding portion), a ground contact member 22, and a conductive partition member 23 (a conductive partition). The surrounding contact portion 20 is formed of a metal material and assembled to the insulating body 13, and surrounds the contact portion 14 of the first signal contact member 16 and the contact portion 17 of the second signal contact member 19. A ground contact member connected to an outer conductor of a coaxial cable in a mate coaxial connector device comes into contact with the surrounding contact portion 20. The surrounding contact portion 20 surrounds at least a portion of the first signal contact member 16 and at least a portion of the second signal contact member 19. The surrounding contact portion 20 is configured to be joined to a ground terminal of the circuit board 11 and to fit into the mate conductive surrounding portion. The ground contact member 22 extends from the surrounding contact portion 20 to the exterior of the insulating body 13. The ground contact member 22 has a ground joint portion 21 connected to a ground terminal disposed on the parts mount surface 11*a* of the circuit board 11. The conductive partition member 23 is supported by a pair of protruding supports 13*a* provided on the insulating body 13 and is interposed between the contact portion 14 of the first signal contact member 16 and the contact portion 17 of the second signal contact member 19. The conductive partition member 23 is provided with a ground potential. As such, the conductive partition member 23 is disposed within a small gap between the contact portion 14 of the first signal contact member 16 and the contact portion 17 of the second signal contact member 19 in the insulating body 13. Accordingly, the contact portion 14 of the first signal contact member 16 and the contact portion 17 of the second signal contact member 19 are electromagnetically shielded from each other by the conductive partition member 23 with which the ground potential is provided. The conductive partition member 23 partitions an inner area of the surrounding contact portion 20 into a first region R11 in which at least a portion of the first signal contact member 16 is disposed and a second region R12 in which at least a portion of the second signal contact member 19 is disposed. The conductive partition member 23 is configured to be joined to a ground terminal of the circuit board 11. The contact portion 14 may be located in the first region R11 within the surrounding contact portion 20 and the signal joint portion 15 may be located outside of the surrounding contact portion 20. The contact portion 17 may be located in the second region R12 the surrounding contact portion 20 and the signal joint portion 18 may be located outside of the surrounding contact portion 20. The coaxial connector device 10 may be configured to transmit only one signal in the first region R11 at any point in time, including the first signal. The coaxial connector device 10 may be configured to transmit only one signal in the second region R12 at any point in time, including the second signal. In some examples, the first signal contact member 16 is the only signal contact located in the first region R11, and the second signal contact member 19 is the only signal contact located in the second region R12. The conductive partition member 23 may be integrally formed with the surrounding contact portion 20. The surrounding contact portion 20 may include a first side wall 20*a* and a second side wall 20*b* facing each other, and the conductive partition may extend from the first side wall 20*a* toward the second side wall 20*b*. The conductive partition member 23 may be a single layer. The conductive partition member 23 is not necessarily limited to a single wall member. The conductive partition member 23 may include a plurality of wall members disposed between the contact portion 14 and the contact portion 17. In this case, there may be a gap between the plurality of wall members. The insulating body 13 may be in contact with each of the first signal contact member 16 surrounding contact portion 20, and the conductive partition member 23 in the first region R11. The insulating body 13 may be in contact with each of the second signal contact member 19, surrounding contact portion 20, and the conductive partition member 23 in the first region R11.

As described above, the coaxial connector device 10 includes the insulating body 13, the first signal contact member 16 having the contact portion 14, the second signal contact member 19 having the contact portion 17, the ground contact member 22, and the conductive partition member 23 interposed between the contact portion 14 of the first signal contact member 16 and the contact portion 17 of the second signal contact member 19 and provided with a ground potential. In the insulating body 13, a portion of the surrounding contact portion 20 of the ground contact member 22 and the conductive partition member 23 form a first conductive wall surrounding the contact portion 14 of the first signal contact member 16, and another portion of the surrounding contact portion 20 of the ground contact member 22 and the conductive partition member 23 form a second conductive wall surrounding the contact portion 17 of the second signal contact member 19. As used herein, the term "surround" includes surrounding with having a gap between a conductive portion and another conductive portion (for example, between the conductive partition member 23 and the surrounding contact portion 20) as shown in FIG. 2. The insulating body 13 may be connected to each of the first signal contact member 16, the surrounding contact portion 20, and the conductive partition member 23 in the first region R11. The insulating body 13 may be connected to each of the second signal contact member 19, the surrounding contact portion 20, and the conductive partition member 23.

As described above, the "coaxial connector" refers to a connector including at least a combination of one signal connection contact member and a conductive partition wall portion surrounding a contact portion of the signal contact member and not surrounding a contact portion of another signal contact member (hereinafter referred to as "coaxial combination"). The coaxial connector device 10 has two sets of coaxial combinations. In the coaxial combination, the central axis of the contact portion and the central axis of the conductive partition wall portion do not necessarily coincide with each other, and at least the central axis of the contact portion may be located in the vicinity of the central axis of the conductive partition wall portion. The term "located in the vicinity" means that the distance between the central axis of the contact portion and the central axis of the conductive partition wall portion is smaller than the minimum value of the distance between the central axis of the contact portion and the conductive partition wall portion.

Figure 4:
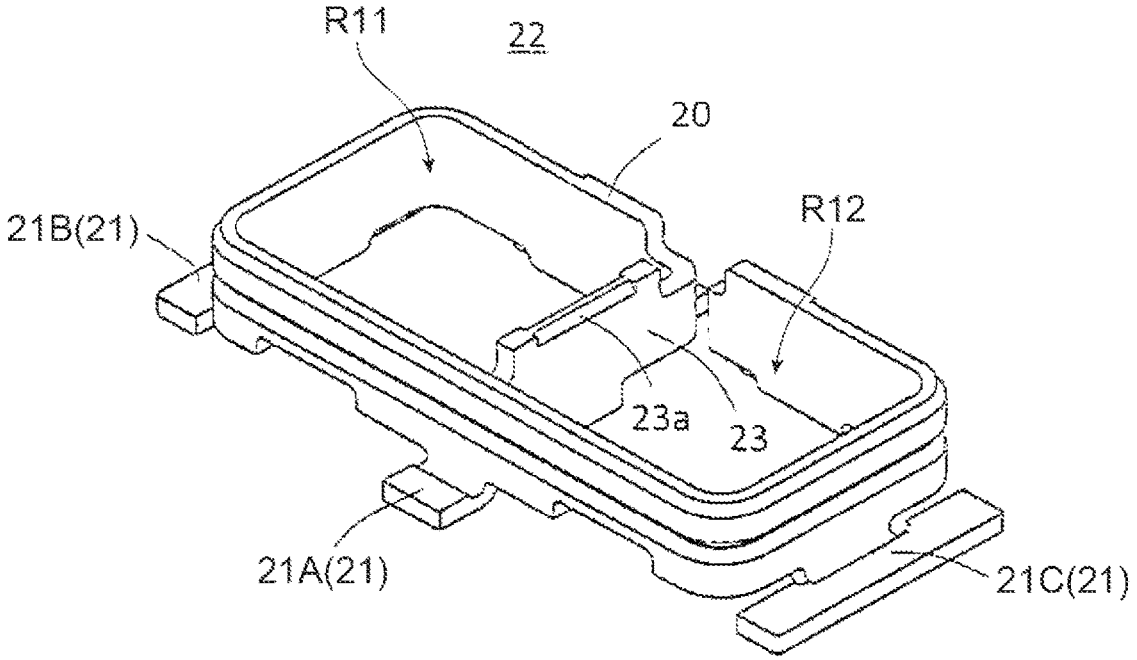
FIG. 4 is a perspective view showing a ground contact member included in an example of the coaxial connector device.

FIG. 4 shows a configuration example of the ground contact member 22. The ground contact member 22 shown in FIG. 4 is formed by punching, pressing, and bending a metal plate. A surrounding contact portion 20 surrounding the contact portion 14 of the first signal contact member 16 and the contact portion 17 of the second signal contact member 19 forms a rectangular annular body. One or more (for example, a plurality of) ground joint portions 21 extend in a bent manner from the surrounding contact portion 20. Each of the ground joint portions 21 is connected to a ground terminal of the circuit board 11. Further, a conductive partition member 23 extends from a part of the surrounding contact portion 20 to be bent inward of the rectangular annular body formed by the surrounding contact portion 20, and divides the rectangular annular body into two parts. The conductive partition member 23 is integrally formed with the ground contact member 22 as part of the surrounding contact portion 20. The ground joint portions 21 may include at least one ground joint portion 21A between the signal joint portion 15 and the signal joint portion 18. The ground joint portions 21 may include two ground joint portions 21A and 21B between which the signal joint portion 15 is located along the surrounding contact portion 20. The ground joint portions 21 may include two ground joint portions 21A and 21C between which the signal joint portion 18 is located along the surrounding contact portion 20.

As shown in FIGS. 1 and 2, an engaging connect portion 23*a* with which a ground contact member of a mate coaxial connector device is engaged is provided at one end portion of the conductive partition member 23. Further, as shown in FIG. 3, in the conductive partition member 23, a board joint portion 23*b* (a first end portion) is provided at the other end portion opposite to the one end portion where the engaging connect portion 23*a* (a second end portion) is provided. The board joint portion 23*b* extends through the insulating body 13 through a through hole 24 (a penetrating hole) provided in the insulating body 13. The board joint portion 23*b* is joined to a ground terminal disposed on the parts mount surface 11*a* of the circuit board 11. The conductive partition member 23 may penetrate the insulating body 13. In a direction of penetrating the insulating body 13, the conductive partition member 23 may have the board joint portion 23*b* and the engaging connect portion 23*a*, and the board joint portion 23*b* may be joined to a ground terminal of the circuit board 11 An inner periphery of the through hole 24 may be spaced apart from the board joint portion 23*b*.

In the coaxial connector device 10 described above, the conductive partition member 23 is integrally formed with the ground contact member 22, but in the coaxial connector device, the conductive partition member 23 is not necessarily integrally formed with the ground contact member 22. The conductive partition member 23 may be configured separately from the ground contact member 22. In this case, the board joint portion 23*b* is provided in the conductive partition member 23, the board joint portion 23*b* extends through the insulating body 13 through the through hole 24 provided in the insulating body 13, and the board joint portion 23*b* is joined to the ground terminal disposed on the parts mount surface 11*a* of the circuit board 11, thereby easily applying the ground potential from the circuit board 11 to the conductive partition member 23 and firmly installing the conductive partition member 23 on the circuit board 11 via the insulating body 13. As in the coaxial connector device 10 described above, when the conductive partition member 23 is formed integrally with the ground contact member 22, the number of components can be reduced to simplify the configuration, and the conductive partition member 23 can be firmly disposed in the insulating body 13.

Figure 5:
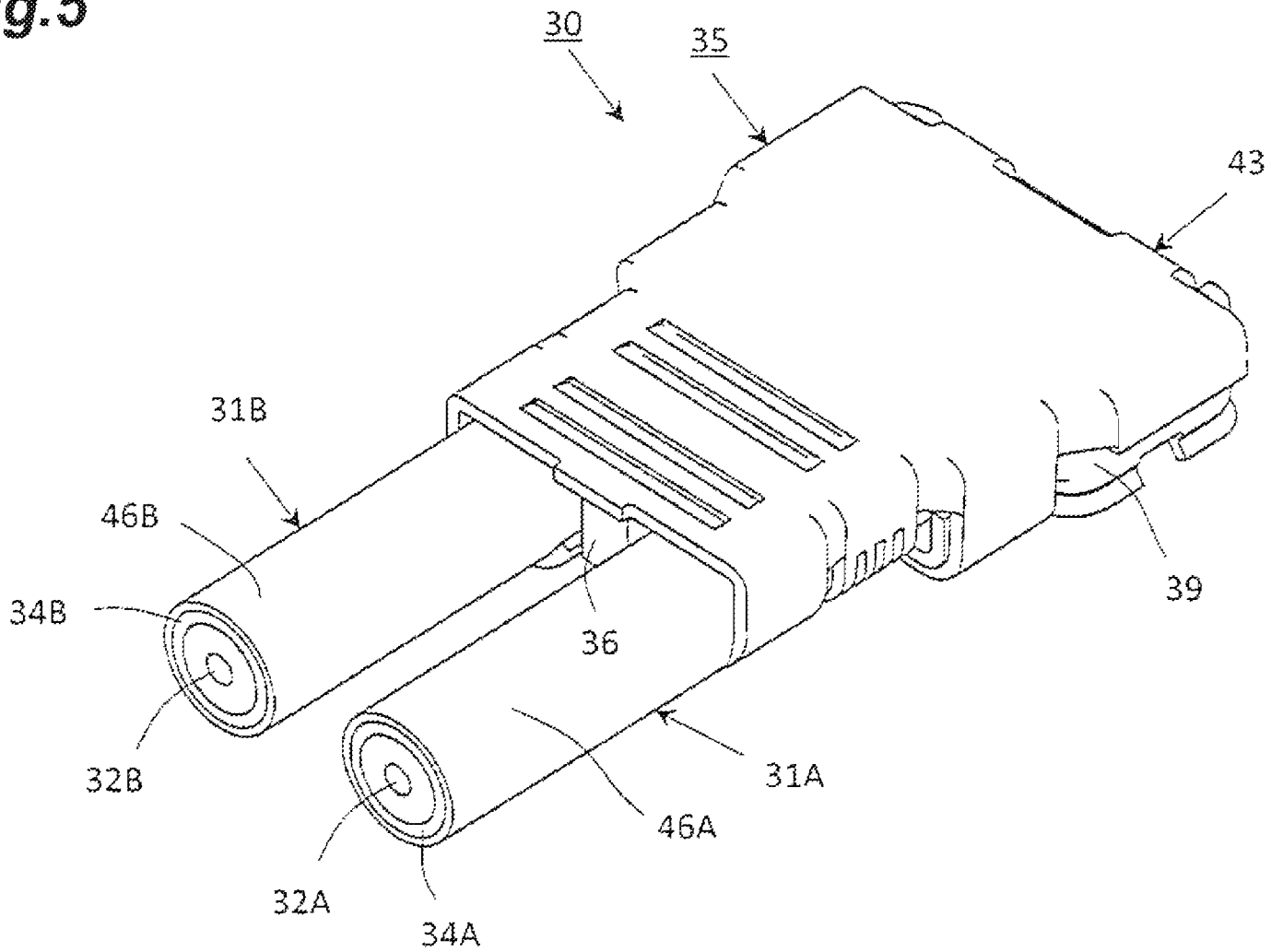
FIG. 5 is a top perspective view of a mate coaxial connector device fitted and connected to an example of the coaxial connector device, with a plurality of coaxial cables connected thereto.
Figure 6:
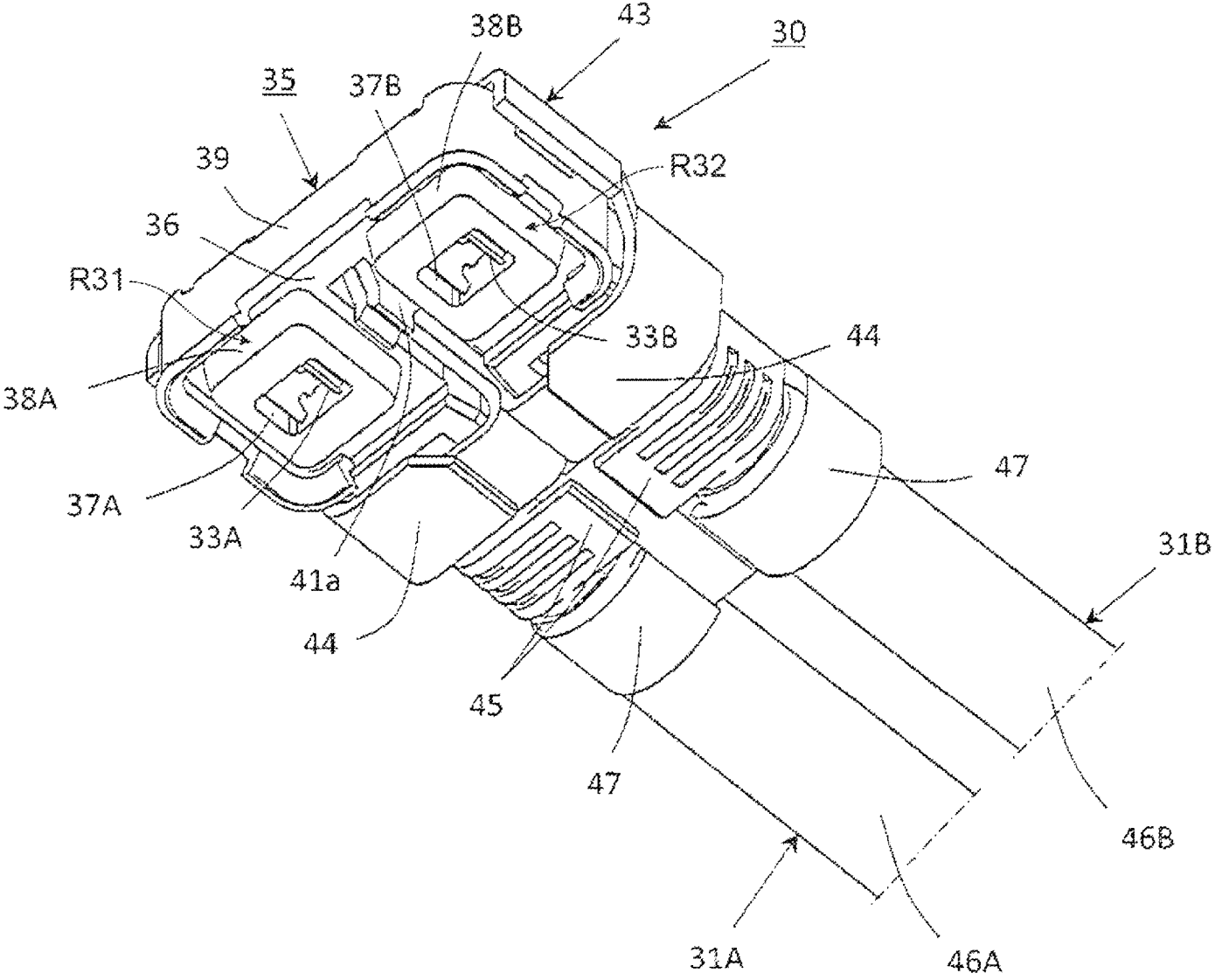
FIG. 6 is a bottom perspective view of the mate coaxial connector device fitted and connected to an example of the coaxial connector device, showing a plurality of coaxial cables connected thereto.

FIGS. 5 and 6 show a cable side coaxial connector device 30, which forms an example of a mate coaxial connector device (a mate connector) that is fitted and connected to the coaxial connector device 10, with a portion of each of two coaxial cables 31A and 31B connected thereto.

The cable side coaxial connector device 30 shown in FIGS. 5 and 6 includes, as main components element, a first signal contact member 33A (a mate first signal contact), a second signal contact member 33B (a mate second signal contact), a ground contact member 35, and an insulating housing 36. The first signal contact member 33A is formed of a conductive material. The first signal contact member 33A is electrically connected to a central conductor 32A of the coaxial cable 31A. The second signal contact member 33B is formed of a conductive material. The second signal contact member 33B is electrically connected to a central conductor 32B of the coaxial cable 31B. The ground contact member 35 is formed of a conductive material. The ground contact member 35 is electrically connected to each of the outer conductor 34A of the coaxial cable 31A and an outer conductor 34B of the coaxial cable 31B to be provided with a ground potential. The insulating housing 36 is formed of an insulating material such as a synthetic resin, and supports the first signal contact member 33A, the second signal contact member 33B, and the ground contact member 35 in a state of being insulated from each other. The coaxial cable 31A is connected to the cable side coaxial connector device 30 such that its central conductor 32A is joined to the first signal contact member 33A and its outer conductor 34A is joined to the ground contact member 35. The coaxial cable 31B is connected to the cable side coaxial connector device 30 such that its central conductor 32B is joined to the second signal contact member 33B and its outer conductor 34B is joined to the ground contact member 35.

The insulating housing 36 has a first base 38A and a second base 38B. A rectangular through hole 37A is formed at the center of the first base 38A. A rectangular through hole 38B is formed at the center of the second base 38B. The first base 38A holds the first signal contact member 33A, and the second base 38B holds the second signal contact member 33B. The ground contact member 35 also includes an annular fitting portion 39 (a mate conductive surrounding portion) that substantially surrounds the first base 38A and the second base 38B of the insulating housing 36. The annular fitting portion 39 is arranged around the first signal contact member 33A held by the first base 38A and the second signal contact member 33B held by the second base 38B. The first base 38A and the second base 38B of the insulating housing 36 and the annular fitting portion 39 of the ground contact member 35 constitute a fitting connect portion of the cable side coaxial connector device 30. The cable side coaxial connector device 30 to which the coaxial cable 31A and the coaxial cable 31B are connected is fitted and connected to the coaxial connector device 10 by the fitting connect portion.

Figure 8:
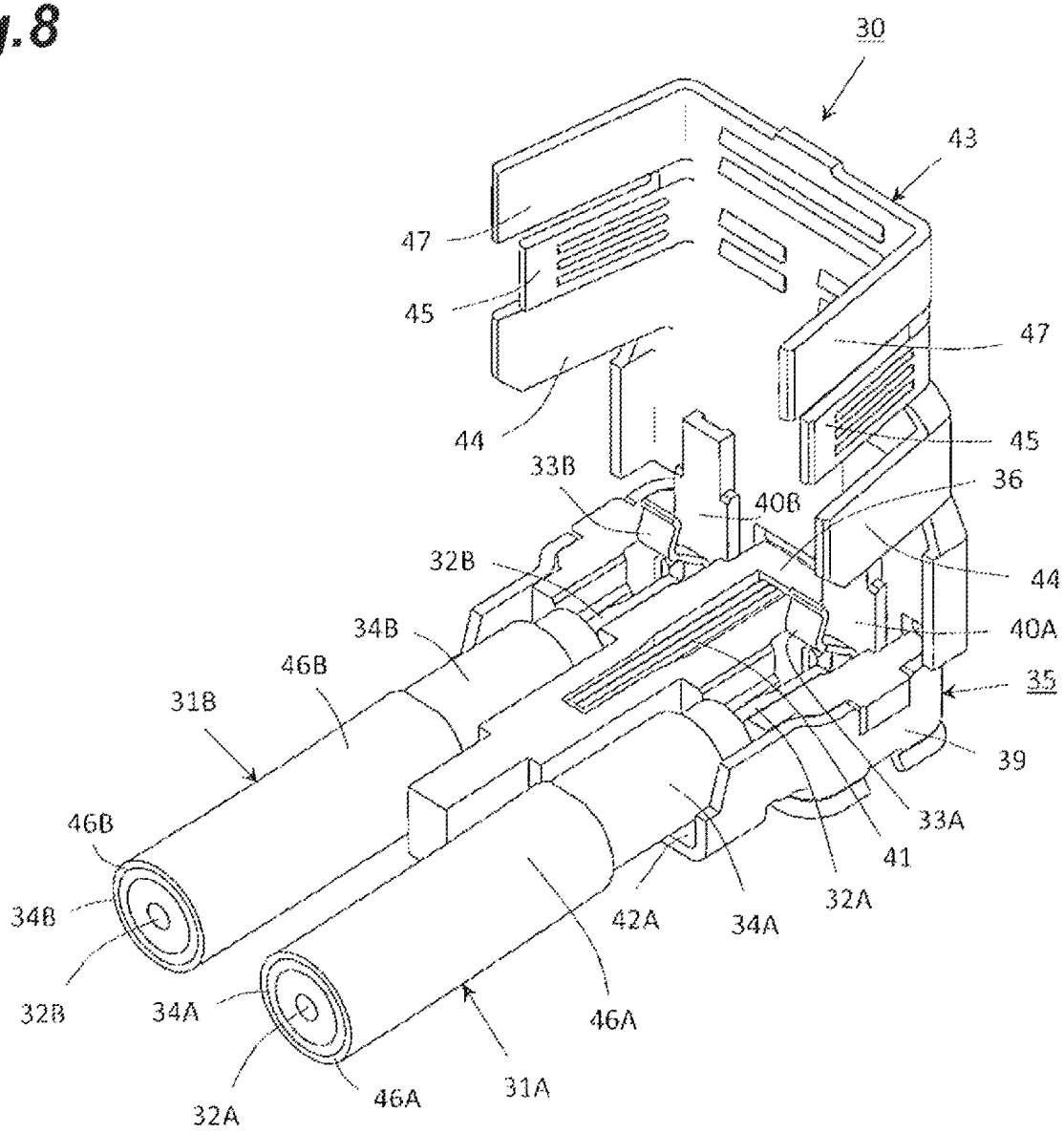
FIG. 8 is a perspective view illustrating a process of connecting the plurality of coaxial cables to the mate coaxial connector device fitted and connected to an example of the coaxial connector device.

As shown in FIG. 8 to be described later, the insulating housing 36 is provided with a bending contact portion 40A extending from one end of the first base 38A in a bendable manner and a bending contact portion 40B extending from one end of the third base 38B in a bendable manner, in addition to the first base 38A and the second base 38B. The bending contact portion 40A and the bending contact portion 40B each form a plate-shaped portion as a whole, and when bent, come into contact with the first signal contact member 33A and the second signal contact member 33B, respectively.

Figure 7:
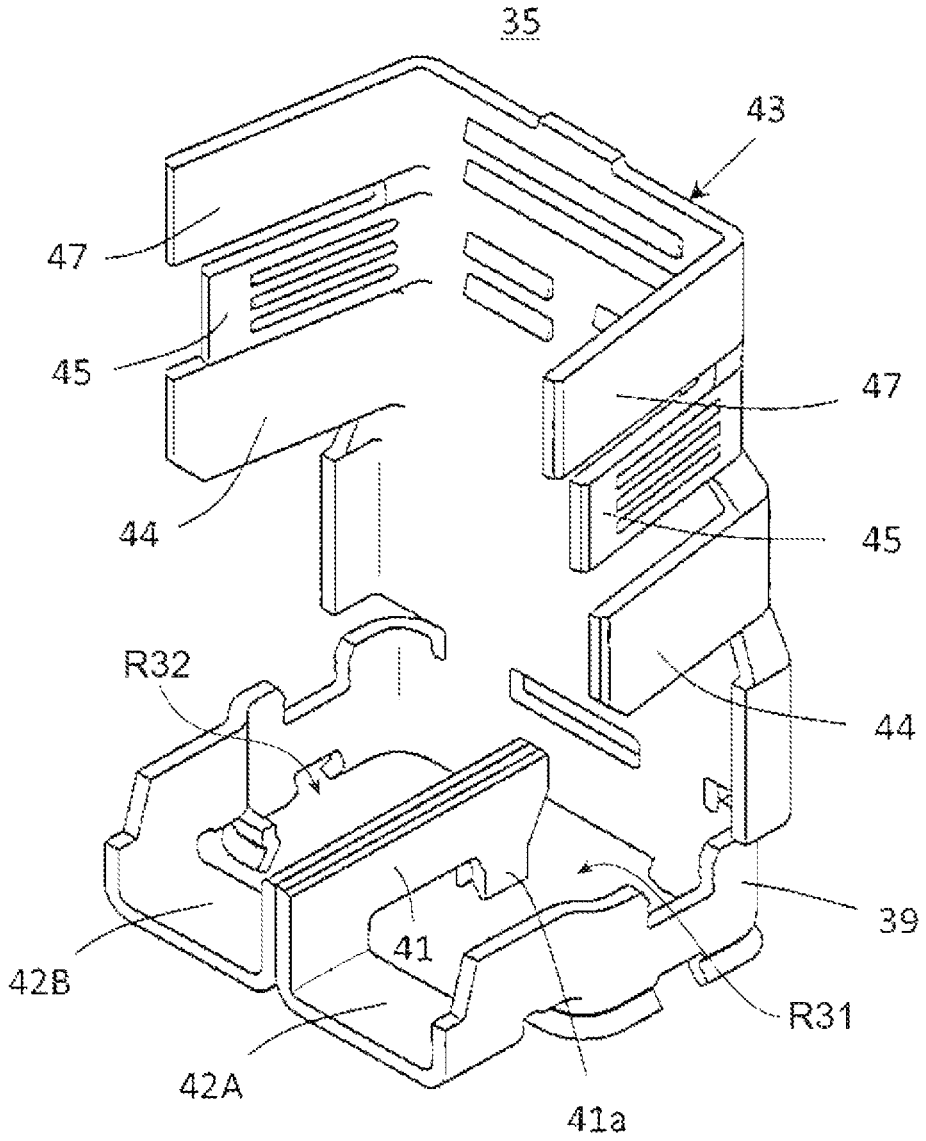
FIG. 7 is a perspective view showing a ground contact member included in the mate coaxial connector device fitted and connected to an example of the coaxial connector device.

As shown in FIG. 7, the annular fitting portion 39 of the ground contact member 35 is provided with a flat partition 41 (a mate conductive partition). The flat partition 41 extends from a portion of the annular fitting portion 39 into an annulus formed by the annular fitting portion 39. The flat partition 41 is disposed between the first signal contact member 33A held by the first base 38A of the insulating housing 36 and the second signal contact member 33B held by the second base 38B of the insulating housing 36 under the condition that the ground contact member 35 is supported by the insulating housing 36, and partitions between the first signal contact member 33A and the second signal contact member 33B. The flat partition 41 may partition an inner area of the annular fitting portion 39 into a mate first region R31 and a mate second region R32. At least a portion of the first signal contact member 33A is disposed in the mate first region R31. At least a portion of the second signal contact member 33B is disposed in the mate second region R32. Thus, with the coaxial cable 31A is connected to the cable side coaxial connector device 30 so that the central conductor 32A is connected to the first signal contact member 33A and the outer conductor 34A is connected to the ground contact member 35, and with the coaxial cable 31B is connected to the cable side coaxial connector device 30 so that the central conductor 32B is connected to the second signal contact member 33B and the outer conductor 34B is connected to the ground contact member 35, the first signal contact member 33A to which the central conductor 32A of the coaxial cable 31A is connected and the second signal contact member 33B to which the central conductor 32B of the coaxial cable 31B is connected are partitioned by the flat partition 41. Since the flat partition 41 is provided with a ground potential through the annular fitting portion 39 of the ground contact member 35, the first signal contact member 33A and the second signal contact member 33B are electromagnetically shielded from each other by the flat partition 41 provided with the ground potential.

An engaging connect portion 41*a* is provided at one end of the flat partition 41. The engaging connect portion 41*a* is configured to be in contact with the engaging connect portion 23*a* provided on the conductive partition member 23 of the coaxial connector device 10 when the cable side coaxial connector device 30 is fitted and connected to the coaxial connector device 10. Since the engaging connect portion 41*a* of the flat partition 41 is in contact with the engaging connect portion 23*a* of the conductive partition member 23, the conductive partition member 23 and the flat partition 41 are firmly connected to each other.

The annular fitting portion 39 of the ground contact member 35 is provided with a pair of cable supports 42A and 42B with the rising portion of the flat partition 41 therebetween. The cable support 42A supports the coaxial cable 31A in which the central conductor 32A is connected to the first signal contact member 33A, and the cable support 42B supports the coaxial cable 31B in which the central conductor 32B is connected to the second signal contact member 33B.

Figure 13:
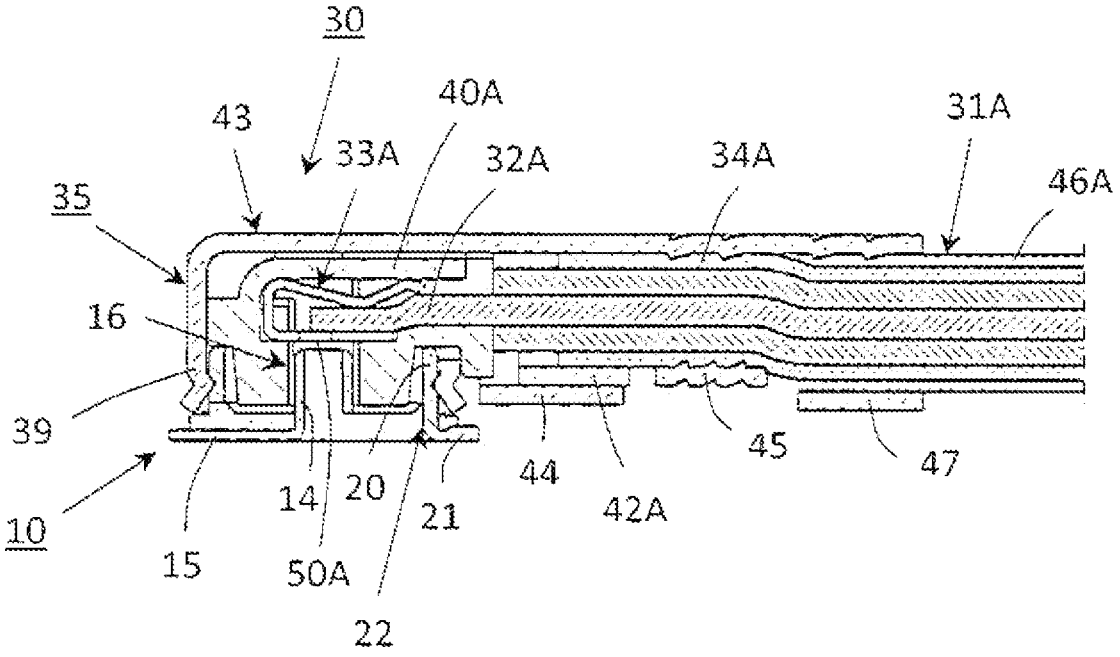
FIG. 13 is a cross-sectional view taken along line XIII-XIII in FIG. 11.

Further, in addition to the annular fitting portion 39, the ground contact member 35 is provided with a shell portion 43 bendably extending from one end of the annular fitting portion 39. As shown in FIG. 13 described later, when the shell portion 43 is bent, the bending contact portions 40A and 40B of the insulating housing 36 are bent accordingly, and the shell portion 43 is connected to the outer conductor 34A of the coaxial cable 31A in which the central conductor 32A is connected to the first signal contact member 33A and the outer conductor 34B of the coaxial cable 31B in which the central conductor 32B is connected to the second signal contact member 33B.

The shell portion 43 is provided with a pair of first bending engagement portions 44, a pair of second bending engagement portions 45, and a pair of third bending engagement portions 47. A pair of first bending engagement portions 44 are bent to engage with cable supports 42A and 42B, respectively. The pair of second bending engagement portions 45 are bent to engage with the outer conductor 34A of the coaxial cable 31A in which the central conductor 32A is connected to the first signal contact member 33A and the outer conductor 34B of the coaxial cable 31B in which the central conductor 32B is connected to the second signal contact member 33B, respectively. The pair of third bending engagement portions 47 are bent to engage with the insulating sheath 46A of the coaxial cable 31A in which the central conductor 32A is connected to the first signal contact member 33A and the insulating sheath 46B of the coaxial cable 31B in which the central conductor 32B is connected to the second signal contact member 33B, respectively.

When the coaxial cable 31A and the coaxial cable 31B are connected to the cable side coaxial connector device 30 including the insulating housing 36, the first signal contact member 33A, the second signal contact member 33B, and the ground contact member 35 as described above, first, as shown in FIG. 8, the coaxial cable 31A and the coaxial cable 31B are disposed on the cable side coaxial connector device 30 in which the shell portion 43 provided on the ground contact member 35 is not bent. The coaxial cable 31A is disposed such that the outer conductor 34A and the central conductor 32A are exposed at one end thereof, the exposed outer conductor 34A is in contact with the cable support 42A of the ground contact member 35, and the exposed central conductor 32A is in contact with the first signal contact member 33A of the cable side coaxial connector device 30. In addition, the coaxial cable 31B is disposed such that the outer conductor 34B and the central conductor 32B are exposed at one end thereof, the exposed outer conductor 34B is in contact with the cable support 42B of the ground contact member 35, and the exposed central conductor 32B is in contact with the second signal contact member 33B of the cable side coaxial connector device 30.

Subsequently, the shell portion 43 of the ground contact member 35 is bent toward the annular fitting portion 39. As a result, the bending contact portion 40A of the insulating housing 36 is bent by the shell portion 43 and pressed against the first signal contact member 33A, so that the central conductor 32A of the coaxial cable 31A is firmly connected to the first signal contact member 33A. At the same time, the bending contact portion 40B of the insulating housing 36 is bent by the shell portion 43 and pressed against the second signal contact member 33B, so that the central conductor 32B of the coaxial cable 31B is firmly connected to the second signal contact member 33B. The bent shell portion 43 comes into contact with the outer conductor 34A of the coaxial cable 31A being in contact with the cable support 42A provided in the annular fitting portion 39, and the coaxial cable 31A having the outer conductor 34A is sandwiched between the shell portion 43 and the cable support 42A. At the same time, the shell portion 43 comes into contact with the outer conductor 34B of the coaxial cable 31B being in contact with the cable support 42B provided in the annular fitting portion 39, and the coaxial cable 31B having the outer conductor 34B is sandwiched between the shell portion 43 and the cable support 42B.

Thereafter, the first bending engagement portions 44 provided in the shell portion 43 are bent to be close to each other and are engaged with the cable supports 42A and 42B supporting the coaxial cable 31A and the coaxial cable 31B, respectively. In addition, the pair of second bending engagement portions 45 provided in the shell portion 43 are bent to be close to each other and are engaged with the outer conductor 34A of the coaxial cable 31A in which the central conductor 32A is connected to the first signal contact member 33A, and the outer conductor 34B of the coaxial cable 31B in which the central conductor 32B is connected to the second signal contact member 33B, respectively.

Further, the pair of third bending engagement portions 47 provided in the shell portion 43 are bent to be close to each other, and are engaged with the insulating sheath 46A of the coaxial cable 31A in which the central conductor 32A is connected to the first signal contact member 33A, and the insulating sheath 46B of the coaxial cable 31B in which the central conductor 32B is connected to the second signal contact member 33B, respectively. Accordingly, the coaxial cable 31A and the coaxial cable 31B are firmly connected to the cable side coaxial connector device 30, and as a result, the cable side coaxial connector device 30 is in the state shown in FIGS. 5 and 6.

When the coaxial connector device 10 and the cable side coaxial connector device 30 are actually used, for example, as shown in FIG. 9, the coaxial connector device 10 is fixed to the circuit board 11 so that the insulating body 13 is disposed on the parts mount surface 11*a* of the circuit board 11, that is, on the surface of the circuit board 11. The cable side coaxial connector device 30 to which the coaxial cable 31A and the coaxial cable 31B are connected is arranged opposite to the coaxial connector device 10 fixed to the circuit board 11. At this time, the first signal contact member 33A and the second signal contact member 33B of the cable side coaxial connector device 30 are disposed at positions corresponding to the contact portion 14 of the first signal contact member 16 and the contact portion 17 of the second signal contact member 19 of the coaxial connector device 10, respectively, and the annular fitting portion 39 of the ground contact member 35 of the cable side coaxial connector device 30 is disposed at a position corresponding to the surrounding contact portion 20 of the ground contact member 22 of the coaxial connector device 10.

Subsequently, the cable side coaxial connector device 30 to which the coaxial cable 31A and the coaxial cable 31B are connected is displaced toward the coaxial connector device 10 fixed to the circuit board 11, and is fitted and connected to the coaxial connector device 10 as shown in FIG. 10. At this time, the first signal contact member 33A to which the central conductor 32A of the coaxial cable 31A of the cable side coaxial connector device 30 is connected and the second signal contact member 33B to which the central conductor 32B of the coaxial cable 31B is connected are respectively in contact with the contact portion 14 of the first signal contact member 16 and the contact portion 17 of the third signal contact member 19 of the coaxial connector device 10. At the same time, in the cable side coaxial connector device 30, the annular fitting portion 39 of the ground contact member 35 connected to each of the outer conductor 34A of the coaxial cable 31A and the outer conductor 34B of the coaxial cable 31B is connected to the surrounding contact portion 20 of the ground contact member 22 of the coaxial connector device 10 by fitting contact. That is, the ground contact member 35 comes into contact with the surrounding contact portion 20. Accordingly, the coaxial cable 31A and the coaxial cable 31B are connected to the circuit board 11 through the cable side coaxial connector device 30 and the coaxial connector device 10, respectively.

Figure 11:
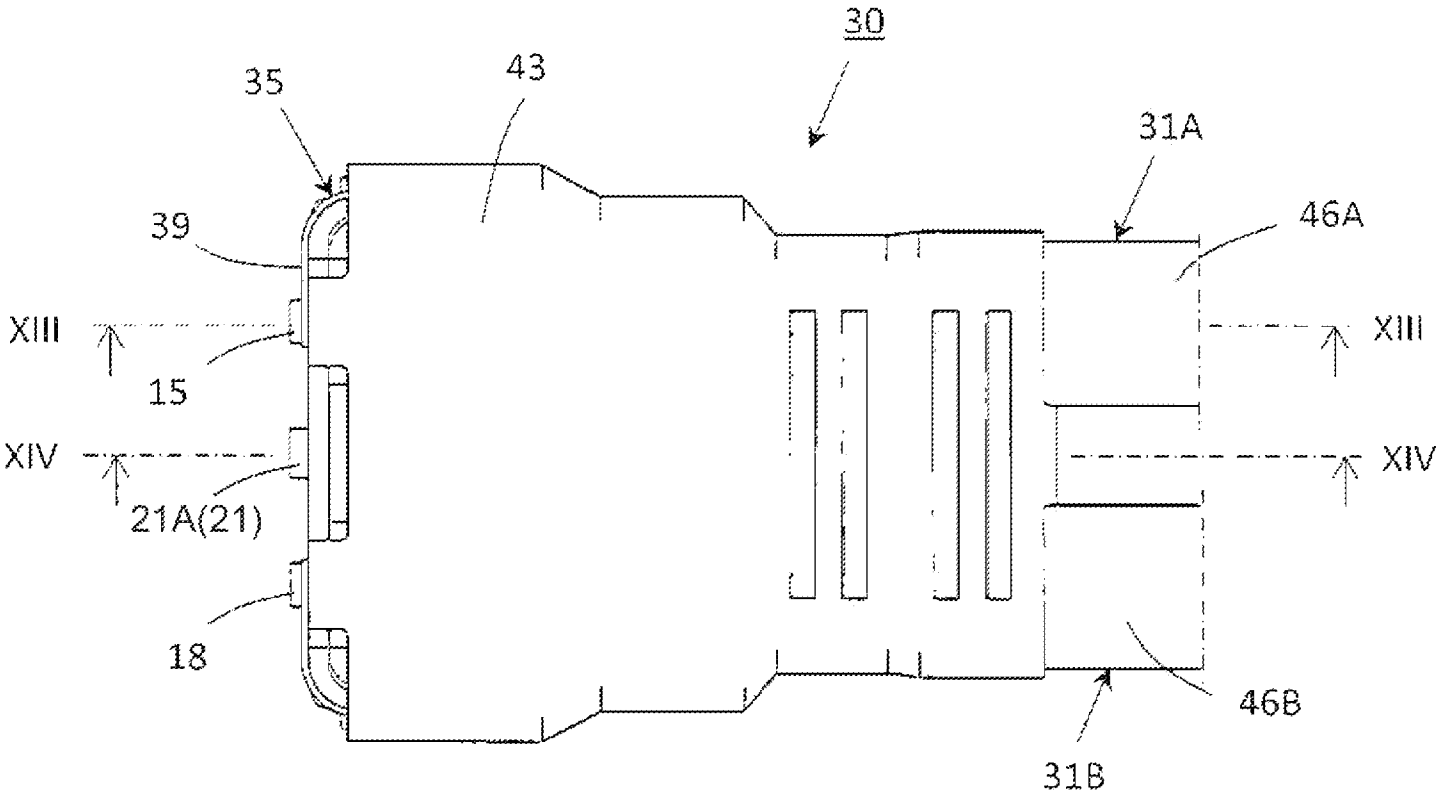
FIG. 11 is a plan view showing a state in which the mate coaxial connector device to which the plurality of coaxial cables are connected is fitted and connected to an example of the coaxial connector device.
Figure 12:
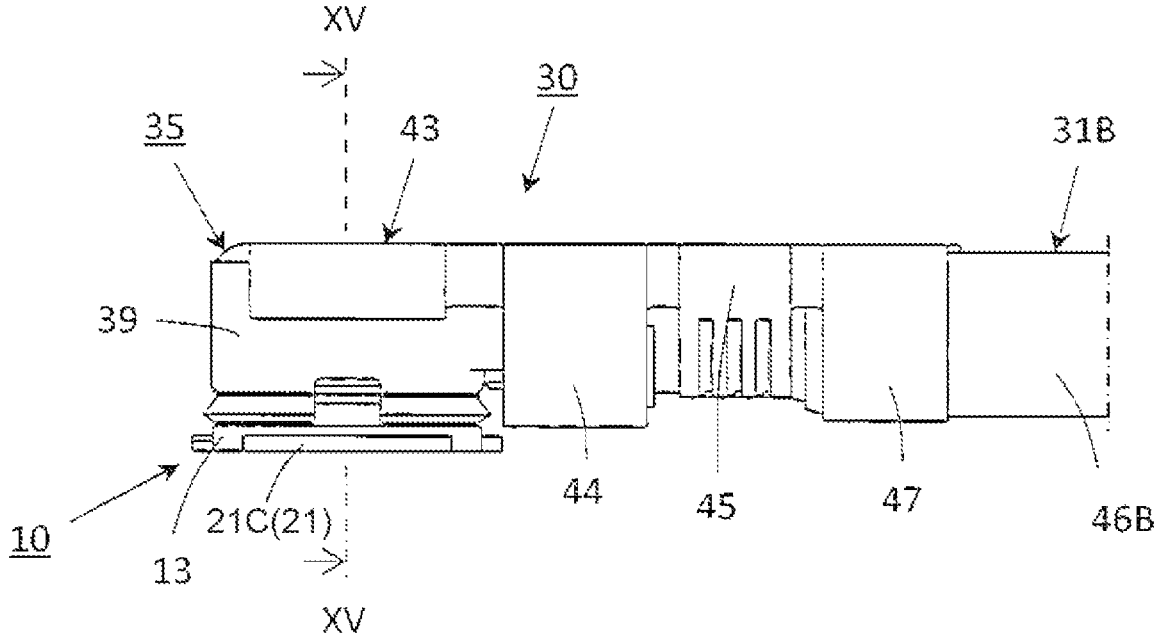
FIG. 12 is a side view showing a state in which the mate coaxial connector device to which the plurality of coaxial cables are connected is fitted and connected to an example of the coaxial connector device.

FIG. 11 (plan view) and FIG. 12 (side view) show a state in which the cable side coaxial connector device 30 to which the coaxial cable 31A and the coaxial cable 31B are connected is fitted and connected to the coaxial connector device 10, with the circuit board 11 omitted. When the cable side coaxial connector device 30 is fitted and connected to the coaxial connector device 10, as shown in FIG. 13, which is a cross-sectional view taken along line XIII-XIII in FIG. 11, in the cable side coaxial connector device 30, the central conductor 32A of the coaxial cable 31A is sandwiched by the first signal contact member 33A pressed by the bending contact portion 40A provided in the insulating housing 36, thereby being connected to the first signal contact member 33A. The outer conductor 34A of the coaxial cable 31A is connected to the cable support 42A and the shell portion 43 provided in the annular fitting portion 39 of the ground contact member 35. Although not shown, in the cable side coaxial connector device 30, the coaxial cable 31B is also connected to the second signal contact member 33B by the central conductor 32B being sandwiched by the second signal contact member 33B pressed by the bending contact portion 40B provided in the insulating housing 36, similarly to the coaxial cable 31A. The outer conductor 34B of the coaxial cable 31B is connected to the cable support 42B and the shell portion 43 provided in the annular fitting portion 39 of the ground contact member 35.

Figure 15:
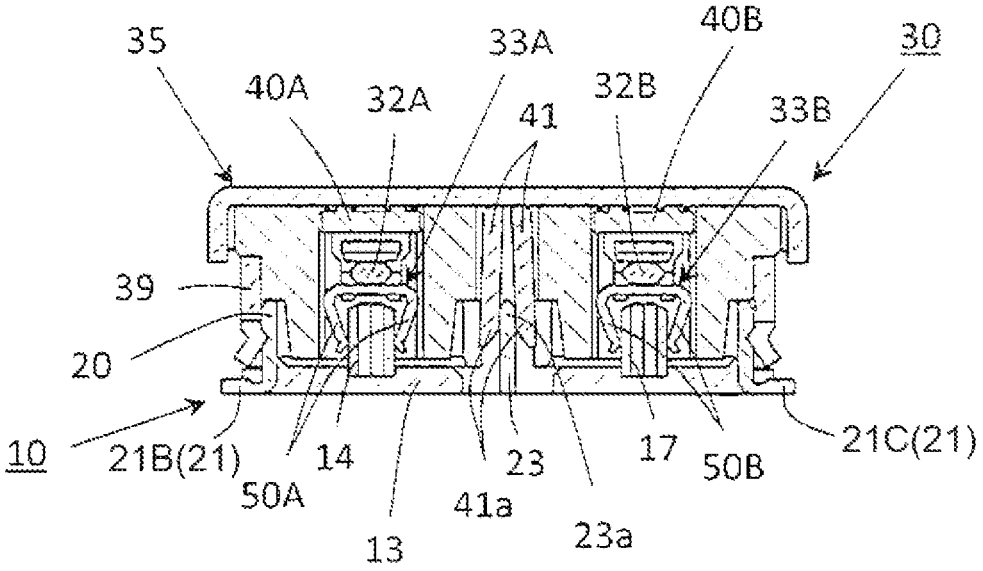
FIG. 15 is a cross-sectional view taken along line XV-XV in FIG. 12.

In addition to FIG. 13 described above, as shown in FIG. 15, which is a cross-sectional view taken along line XV-XV in FIG. 12, a pair of mutually facing contact parts 50A provided on the first signal contact member 33A are in contact with the contact portion 14 of the first signal contact member 16 of the coaxial connector device 10 by sandwiching the contact portion 14. In addition, a pair of mutually facing contact parts 50B provided on the second signal contact member 33B are in contact with the contact portion 17 of the second signal contact member 19 of the coaxial connector device 10 by sandwiching the contact portion 17. The annular fitting portion 39 of the ground contact member 35 is in contact with the surrounding contact portion 20 of the ground contact member 22 of the coaxial connector device 10.

Figure 14:
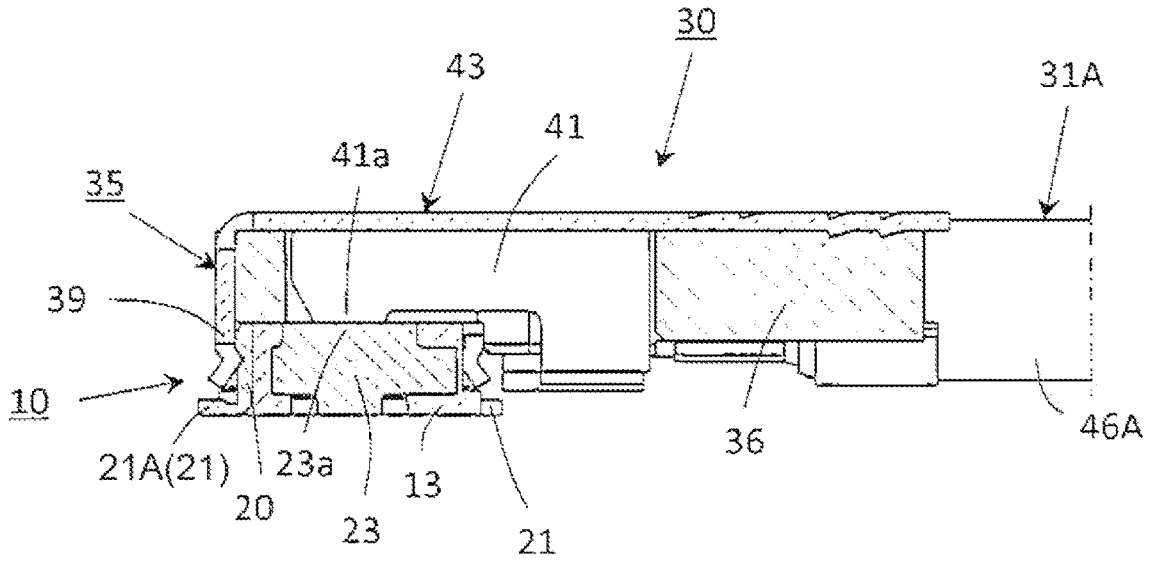
FIG. 14 is a cross-sectional view taken along line XIV-XIV in FIG. 11.

Further, as shown in FIG. 14, which is a cross-sectional view taken along line XIV-XIV in FIG. 11, the engaging connect portion 41*a* provided on the flat partition 41 provided on the annular fitting portion 39 of the ground contact member 35 of the cable side coaxial connector device 30 is in contact with and engaged with the engaging connect portion 23*a* provided on the conductive partition member 23 of the coaxial connector device 10. The engaging connect portion 23*a* may be in contact with the flat partition 41 when the surrounding contact portion 20 is fitted into the annular fitting portion 39. Accordingly, the conductive partition member 23 of the coaxial connector device 10 and the flat partition 41 of the cable side coaxial connector device 30 are engaged with each other in a state where a ground potential is provided.

According to the coaxial connector device 10 as an example of the coaxial connector device, the contact portion 14 of the first signal contact member 16 and the contact portion 17 of the second signal contact member 19, which are commonly surrounded by the surrounding contact portion 20 of the ground contact member 22, are disposed close to each other at a small gap on the insulating body 13 disposed on the parts mount surface 11*a* of the circuit board 11. Accordingly, since the area of the insulating body 13 is reduced, the area occupied by the coaxial connector device 10 in the parts mount surface 11*a* of the circuit board 11 on which the insulating body 13 is disposed can be reduced.

Since the conductive partition member 23 with which the ground potential is provided is disposed in the small gap between the contact portion 14 of the first signal contact member 16 and the contact portion 17 of the second signal contact member 19, the contact portion 14 of the first signal contact member 16 and the contact portion 17 of the second signal contact member 19 are electromagnetically shielded from each other by the conductive partition member 23 with which the ground potential is provided. As a result, the radio frequency signal transmitted through the contact portion 14 of the first signal contact member 16 is suppressed from mixing as crosstalk noise into the radio frequency signal transmitted through the contact portion 17 of the second signal contact member 19, and the radio frequency signal transmitted through the contact portion 17 of the second signal contact member 19 is suppressed from mixing as crosstalk noise into the radio frequency signal transmitted through the contact portion 14 of the first signal contact member 16. As a result, a situation in which transmission characteristics of radio frequency signals transmitted through the contact portion 14 of the first signal contact member 16 and the contact portion 17 of the second signal contact member 19 are degraded may be avoided.

Further, in the coaxial connector device 10, since the board joint portion 23*b* extending through the insulating body 13 to be joined to the ground terminal disposed on the parts mount surface 11*a* of the circuit board 11 is provided on the conductive partition member 23, the ground potential can be easily applied from the circuit board 11 to the conductive partition member 23, and the conductive partition member 23 interposing the insulating body 13 can be firmly installed on the circuit board 11.

Further, in the coaxial connector device 10, since the conductive partition member 23 is integrally formed with the ground contact member 22 so as to be bent and extended from a part of the surrounding contact portion 20 of the ground contact member 22, the number of components can be reduced, the structure can be simplified, and the conductive partition member 23 can be firmly disposed in the insulating body 13.

Although certain procedures or operations are described herein as being performed sequentially or in a particular order, in some examples one or more of the operations may be performed in a different order, in parallel, simultaneously with each other, or in an overlapping manner. Additionally, in some examples, one or more of the operations may be optionally performed or, in some cases, omitted altogether.

We claim all modifications and variations coining within the spirit and scope of the subject matter claimed herein.

INDUSTRIAL APPLICABILITY

According to the coaxial connector device as described above, when the coaxial connector device is mounted on the parts mount surface of the circuit board and the cable side coaxial connector device to which a plurality of coaxial cables are connected is fitted and connected to the board side coaxial connector device, the area occupied by the board side coaxial connector device on the parts mount surface of the circuit board can be reduced. In addition, a situation in which the transmission characteristic of the radio frequency signal transmitted through the board side coaxial connector device deteriorates may be avoided. The coaxial connector device can be widely applied to various electronic devices.

What is claimed is:

1. A coaxial connector device comprising:

an insulating body disposed on a surface of a circuit board;

first and second signal contact members each of which is assembled to the insulating body and comprises:

a contact portion configured so that a signal contact member of a mate connector device comes into contact with the contact portion; and a signal joint portion configured to be joined to a signal terminal portion disposed on the circuit board;

a ground contact member assembled to the insulating body and comprising:

a surrounding contact portion surrounding the contact portion of each of the first and second signal contact members and configured so that a ground contact member of the mate connector device comes into contact with the surrounding contact portion; and a ground joint portion configured to be joined to a ground terminal disposed on the circuit board; and a conductive partition member disposed between the contact portion of the first signal contact member and the contact portion of the second signal contact member and configured to be provided with a ground potential.

2. The coaxial connector device according to claim 1, wherein the conductive partition member comprises a board joint portion extending through the insulating body to be joined to the ground terminal disposed on the circuit board.

3. The coaxial connector device according to claim 1, wherein the conductive partition member is integrally formed with the ground contact member.

4. The coaxial connector device according to claim 3, wherein the conductive partition member is formed to be bent and extend from a portion of the surrounding contact portion of the ground contact member.

5. The coaxial connector device according to claim 1, wherein the conductive partition member comprises an engaging connect portion configured to engage with the ground contact member of the mate connector device.

6. The coaxial connector device according to claim 1, wherein a portion of the surrounding contact portion of the ground contact member and the conductive partition member form a first conductive wall surrounding the contact portion of the first signal contact member and not surrounding a contact portion of another signal connection contact member.

7. The coaxial connector device according to claim 1, wherein a portion of the surrounding contact portion of the ground contact member and the conductive partition member form a first conductive wall surrounding the contact portion of the first signal contact member and not surrounding a contact portion of another signal connection contact member, and wherein another portion of the surrounding contact portion of the ground contact member and the conductive partition member form a second conductive wall surrounding the contact portion of the second signal contact member and not surrounding a contact portion of another signal connection contact member.

8. A connector for connecting a circuit board to a mate connector having a mate first signal contact, a mate second signal contact, and a mate conductive surrounding portion surrounding at least a portion of the mate first signal contact and at least a portion of the mate second signal contact, the connector comprising:

a first signal contact configured to be joined to a first signal terminal of the circuit board and to be in contact with the mate first signal contact to transmit a first signal;

a second signal contact configured to be joined to a second signal terminal of the circuit board and to be in contact with the mate second signal contact to transmit a second signal;

a conductive surrounding portion surrounding at least a portion of the first signal contact and at least a portion of the second signal contact, the conductive surrounding portion configured to be joined to a ground terminal of the circuit board and to fit into the mate conductive surrounding portion; and a conductive partition partitioning an inner area of the conductive surrounding portion into a first region in which at least a portion of the first signal contact is disposed and a second region in which at least a portion of the second signal contact is disposed, the conductive partition configured to be joined to a ground terminal of the circuit board, wherein the connector is configured to transmit only one signal in the first region at any point in time, including the first signal, and wherein the connector is configured to transmit only one signal in the second region at any point in time, including the second signal.

9. The connector according to claim 8, wherein the first signal contact is the only signal contact located in the first region, and wherein the second signal contact is the only signal contact located in the second region.

10. The connector according to claim 8, wherein the conductive partition is integrally formed with the conductive surrounding portion.

11. The connector according to claim 10, wherein the conductive surrounding portion comprises a first side wall and a second side wall facing each other, and wherein the conductive partition extends from the first side wall toward the second side wall.

12. The connector according to claim 8, further comprising an insulating housing that holds: the first signal contact; the second signal contact; the conductive surrounding portion; and the conductive partition, wherein the conductive partition penetrates the insulating housing.

13. The connector according to claim 12, wherein in a direction of penetrating the insulating housing, the conductive partition has a first end portion and a second end portion, and wherein the first end portion is joined to a ground terminal of the circuit board.

14. The connector according to claim 13, wherein the mate connector further comprises a mate conductive partition that partitions an inner area of the mate conductive surrounding portion into a mate first region and a mate second region, wherein at least a portion of the mate first signal contact is disposed in the mate first region and at least a portion of the mate second signal contact is disposed in the mate second region, and wherein the second end portion is in contact with the mate conductive partition when the conductive surrounding portion is fitted into the mate conductive surrounding portion.

15. The connector according to claim 13, wherein the insulating housing comprises a penetrating hole through which the conductive partition penetrates, and wherein an inner periphery of the penetrating hole is spaced apart from the first end portion.

16. The connector according to claim 13, wherein the conductive surrounding portion comprises one or more ground joint portions joined to a ground terminal of the circuit board.

17. The connector according to claim 16, wherein the first signal contact comprises a first joint portion configured to be joined to the first signal terminal and a first contact portion configured to be in contact with the mate first signal contact, wherein the second signal contact comprises a second joint portion configured to be joined to the second signal terminal and a second contact portion configured to be in contact with the mate second signal contact, wherein the first contact portion is located in the first region within the conductive surrounding portion and the first joint portion is located outside of the conductive surrounding portion, wherein the second contact portion is located in the second region within the conductive surrounding portion and the second joint portion is located outside of the conductive surrounding portion, and wherein the one or more ground joint portions include at least one ground joint portion located between the first joint portion and the second joint portion.

18. The connector according to claim 17, wherein the one or more ground joint portions include two ground joint portions between which the first joint portion is located along the conductive surrounding portion and two additional ground joint portions between which the second joint portion is located along the conductive surrounding portion.

19. The connector according to claim 13, wherein the insulating housing is connected to each of the first signal contact, the conductive surrounding portion, and the conductive partition in the first region, and wherein the insulating housing is connected to each of the second signal contact, the conductive surrounding portion, and the conductive partition in the second region.

20. The connector according to claim 8, wherein the conductive partition is a single layer.

* * * * *